US006505833B2

(12) United States Patent
Kato et al.

(10) Patent No.: US 6,505,833 B2
(45) Date of Patent: Jan. 14, 2003

(54) RECORDING SHEET FEEDING DEVICE

(75) Inventors: Kenichi Kato, Kanagawa (JP); Youichi Kimura, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 33 days.

(21) Appl. No.: 09/886,260

(22) Filed: Jun. 22, 2001

(65) Prior Publication Data

US 2001/0054792 A1 Dec. 27, 2001

(30) Foreign Application Priority Data

Jun. 23, 2000 (JP) ..... 2000-188601

(51) Int. Cl.[7] ..... B65H 5/02
(52) U.S. Cl. ..... 271/272; 271/188
(58) Field of Search ..... 271/188, 272

(56) References Cited

U.S. PATENT DOCUMENTS 3,650,448 A * 3/1972 Jarmy ..... 226/108
3,890,886 A * 6/1975 Fessler et al. ..... 225/93
4,168,506 A * 9/1979 Corsover ..... 346/136
4,370,041 A * 1/1983 Katsuyama ..... 352/72
5,152,522 A * 10/1992 Yamashita ..... 226/185
5,201,424 A * 4/1993 Hain ..... 209/534
5,358,239 A * 10/1994 Hario et al. ..... 271/186
5,742,318 A * 4/1998 Miyauchi et al. ..... 271/251
5,743,663 A * 4/1998 Imai ..... 347/174
5,913,345 A * 6/1999 Corrado et al. ..... 15/3
5,988,907 A * 11/1999 Iso ..... 400/636
6,147,779 A * 11/2000 Bolton et al. ..... 358/487
6,428,162 B2 * 8/2002 Kato ..... 347/104

OTHER PUBLICATIONS

Merriam–Webster's Collegiate Dictionary, 10th edition, p. 170.*

* cited by examiner

*Primary Examiner*—Christopher P. Ellis
*Assistant Examiner*—Richard Ridley
(74) *Attorney, Agent, or Firm*—Sughrue Mion, PLLC

(57) ABSTRACT

First and second feeding roller pairs are disposed at positions upstream and downstream of a recording position to record an image onto a recording sheet. Each of the first and second feeding roller pairs includes a capstan roller and a pinch roller, which are located below and above a passage of the recording sheet. The capstan roller and the pinch roller has plural orbital grooves arranged along an axial direction, to relax the strain of the recording sheet with respect to the widthwise direction of the recording sheet. The depth of the orbital grooves of the pinch rollers are set to 0.3 mm, which is shallower than that of the orbital grooves of the capstan rollers. The shallow orbital grooves of the pinch rollers are capable of suppress the curl of the recording sheet effectively.

13 Claims, 9 Drawing Sheets

RECORDING SHEET FEEDING DEVICE

BACKGROUND OF THE INVENTION

1. Field of the Invention

The present invention relates to a device for feeding a recording sheet at a certain speed with high precision, preventing exposure unevenness caused by curl of the recording sheet.

2. Background Arts

In a printer processor, for instance, linear recording light beams are applied to a recording area of a photosensitive recording sheet in a main scan direction while the recording sheet is fed in a sub-scan direction perpendicular to the main scan direction, to record an image. Along a passage of the recording sheet are provided a plurality of feeding roller pairs, each of which transfers the recording sheet to the next one. In the vicinity of a record position to which the recording light beams are applied, the recording sheet is nipped by a first feeding roller pair, fed toward the record position, and transferred to a second feeding roller pair. These feeding roller pairs are controlled to be equal in the feeding speed.

Each of the first and second feeding roller pairs has a capstan roller and pinch roller which are located below and above the feeding passage of the recording sheet. Each of the capstan roller and the pinch roller has plural orbital grooves along an axial direction thereof, to divide outer surfaces of the capstan and the pinch rollers into plural roller bodies. The recording sheet is pressed by these roller bodies which is separated in the main scan direction, so it is possible to relax the strain or the deformation of the recording sheet with respect to the widthwise direction (main scan direction). Moreover, it is possible to prevent a crease in the recording sheet. Furthermore, the recording sheet is kept at a certain position with high accuracy with respect to the main scan direction, even when the recording sheet is completely passed the feeding roller pair, to prevent deviation in recorded position of the recording sheet.

On the other hand, the recording surface of the recording sheet is not entirely flat, but is curled in the widthwise or lengthwise direction. The recording area is not bent when the recording sheet is nipped and fed by the first and second feeding rollers. When passing the first feeding roller pair, however, the trailing end of the recording sheet is bent upward or downward, which causes deviation in exposed position. In that case, density unevenness in the recording sheet could be occurred. Moreover, before passing the second feeding roller pair, the leading end of the recording sheet is curled, so there is a possibility to occur density unevenness in a print image, as mentioned above.

In order to prevent bending of the recording sheet, it is preferable to position the recording sheet such that the both lateral ends thereof are come in contact with the roller bodies. However, this condition is depended upon width of the recording sheet. When positioned between the roller bodies, the both lateral ends of the recording sheet is curled, which causes exposure unevenness, as set above. In addition, a roller with no orbital grooves may be applicable for preventing the curl of the recording sheet. But in that case, strain or deformation in the main scan direction may be occurred, as described above.

SUMMARY OF THE INVENTION

In view of the foregoing, an object of the present invention is to provide a device for feeding a recording sheet capable of r educing strain and curl of the recording sheet effectively.

To achieve the above objects, a device for feeding a recording sheet comprises a first feeding roller pair having a first pinch roller and a first capstan roller, a second feeding roller pair having a second pinch roller and a second capstan roller, an d a plurality of orbital grooves formed in an outer surface of the second pinch roller and arranged in an axial direction of the second pinch roller. The depth of the orbital grooves is within a range of 0.2 mm to 0.7 mm.

In the preferred embodiment, the first pinch roller has a plurality of orbital grooves in an outer surface thereof, and the depth of the orbital grooves is within a range of 0.2 mm to 0.7 mm, in the same way as those of the second pinch roller. The first and second capstan rollers also have a plurality of orbital grooves, which are confronted with the orbital grooves of the corresponding pinch roller. The depth of the orbital grooves of the capstan rollers is set to 1.0 mm.

The capstan rollers and the pinch rollers are covered with elastic members, such as silicon rubbers. Between the first and second capstan rollers is disposed a guide member which has a guiding surface for supporting the recording sheet. The guiding surface is located to be 0.01 mm to 0.08 mm lower than the top level of the first and second capstan rollers. When the recording sheet is nipped by the feeding roller pair, the elastic member of the capstan roller is deformed such that the top level of the capstan roller becomes the same level as the guiding surface. Moreover, the guide member has plural guiding projections extended in a feeing direction of the recording sheet. The guiding projections are tapered off and fit into the orbital grooves of the capstan rollers. This ensures smooth conveyance of the recording sheet.

According to the present invention, the orbital grooves of the pinch rollers, shallower than those of the capstan rollers, are able to relax the strain of the recording sheet in the widthwise direction, and to suppress the curls of the recording sheet. Since the recording sheet is not deviated from the proper position, recording light beams from a recording device are applied to proper positions on the recording sheet, so exposure unevenness in the recording sheet can be prevented.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE EMBODIMENT

Figure 1:
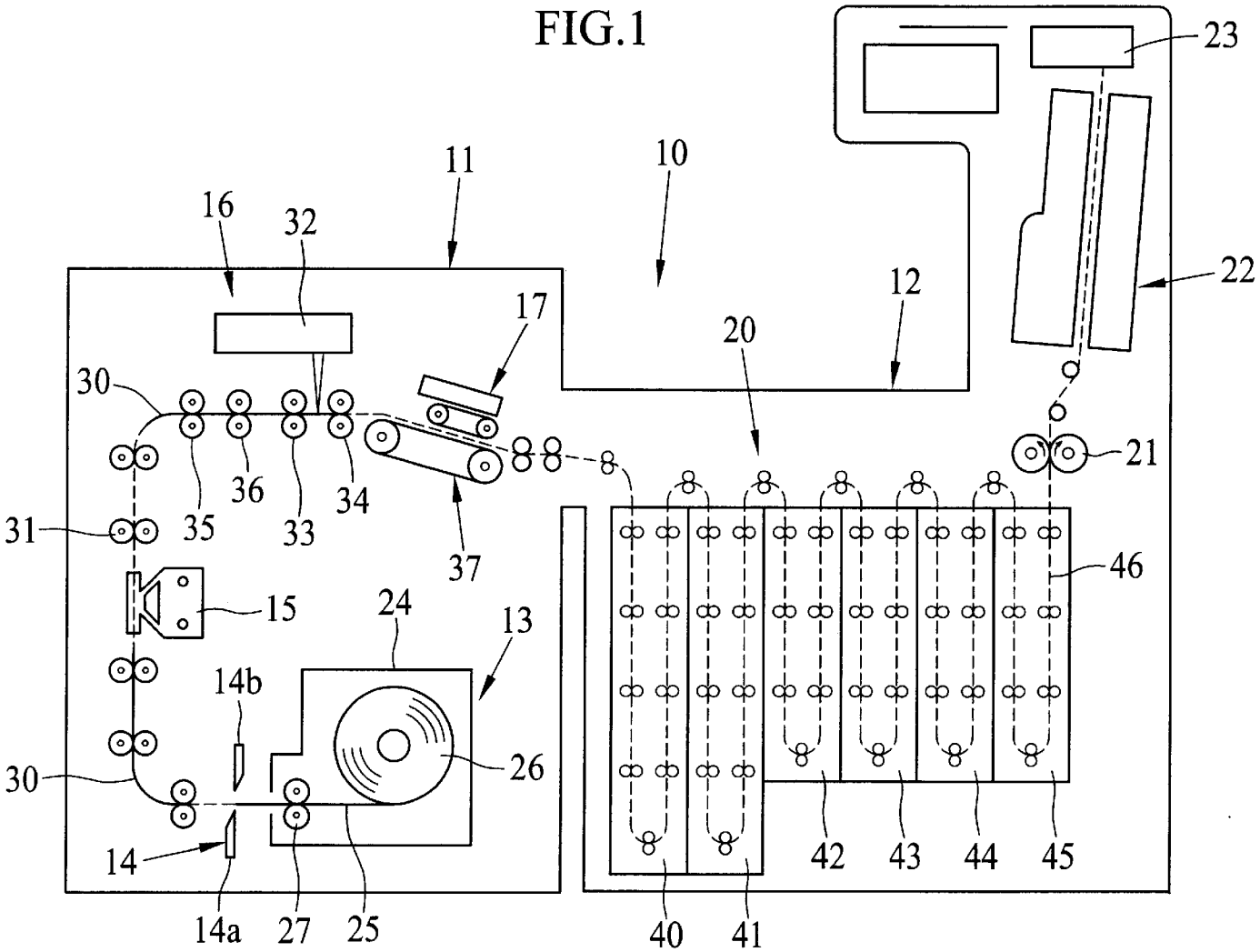
FIG. 1 is a schematic view of a printer processor having a sheet feeding device of the present invention.

In FIG. 1, a printer processor 10 is comprised of a printer section 11 and a processor section 12, which are connected to each other. The printer section 11 includes a paper loader 13, a paper cutter 14, a rear side printer 15, an exposure unit 16 and a sheet sorter 17. The processor section 12 includes a development/fixation device 20, a squeeze roller pair 21, a drier 22 and a sheet collection unit 23.

A paper magazine 24 is loaded in the paper loader 13, and includes a photosensitive recording paper 25, which is wound into a paper roll 26. For instance, the photosensitive paper is formed by coating a mixture of a white pigment and a resin including a polyester, on an emulsion-coated surface (recording surface) of a base sheet. The paper magazine 24 is provided with a feeding roller pair 27, which is driven by a feeding motor (not shown). When the feeding roller set 27 rotates, the photosensitive recording paper 25 is drawn from the paper roll 26, and fed to the rear side printer 15.

The paper cutter 14 includes a fixed blade 14*a* and a movable blade 14*b*, which are positioned between the paper loader 13 and the rear side printer 15. When the photosensitive paper 15 is advanced beyond the paper cutter 14 by a predetermined length, the movable blade 14b is moved toward the fixed blade 14*a* to cut the photosensitive paper 25 to produce a recording sheet 30. The recording sheet 30 is conveyed along a paper guide (not shown) by a conveyor roller sets 30, and forwarded sequentially to a rear side printer 15, the exposure unit 16 and the sheet sorter 17.

The rear side printer 15 records necessary information on a rear surface (opposite surface of emulsion-coated surface) of the recording sheet 30. The exposure unit 16 has an exposure device 32 for projecting recording light beams toward an recording position, and a sheet feeding device for conveying the recording sheet 30 inside of the exposure unit 16. The sheet feeding device includes a first feeding roller pair 33 for feeding the unexposed recording sheet 30 to the exposure position, a second feeding roller pair 34 for sending the exposed recording sheet 30 to a belt conveyor 37, and transfer roller pairs 35, 36 for transferring the recording sheet 30 to the feeding roller pair 33.

The exposure device 32 includes a well-known laser printer. The exposure device 32 modulates the intensities of recording light beams based on image data stored in an image memory, and projects modulated recording light beams toward the recording sheet 30 which is conveyed by the roller pairs 33 to 36. Exposed recording sheets 30 are transferred to the belt conveyor 37, arranged in plural rows by the sheet sorter 17, and sent to the development/fixation device 20.

The development/fixation device 20 is comprised of a developing tank 40, a fixing tank 41, first to fourth washing tanks 42, 43, 44, 45, which are filled up with developing solution, fixing solution and washing solution respectively.

Each of these processing tanks 40 to 45 includes a thermo sensor and heaters, and is controlled temperature of respective processing solutions to be within a predetermined range. While being conveyed inside the development/fixation device 20 along a passage 46, shown by a dotted line, the recording sheet 30 is subjected to development, fixation and washing processes.

After passing through the washing tanks 42 to 45, the recording sheet 30 is nipped by the squeeze roller pair 21. While the recording sheet 30 is conveyed by the squeeze roller pair 21, washing solution is wrung out from both surfaces of the recording sheet 30, and poured into the fourth washing tank 45.

The drier 22 includes a heater unit, a fan and so forth, and applies hot drying air to the recording surface of the recording sheet 30, which is dried completely. Afterward, the recording sheets 30 are fed to the collection device 23 to get the recording sheets 30 from the drier 22 together, sorted by a sorter (not shown), and advanced out of the printer processor 10.

Figure 2:
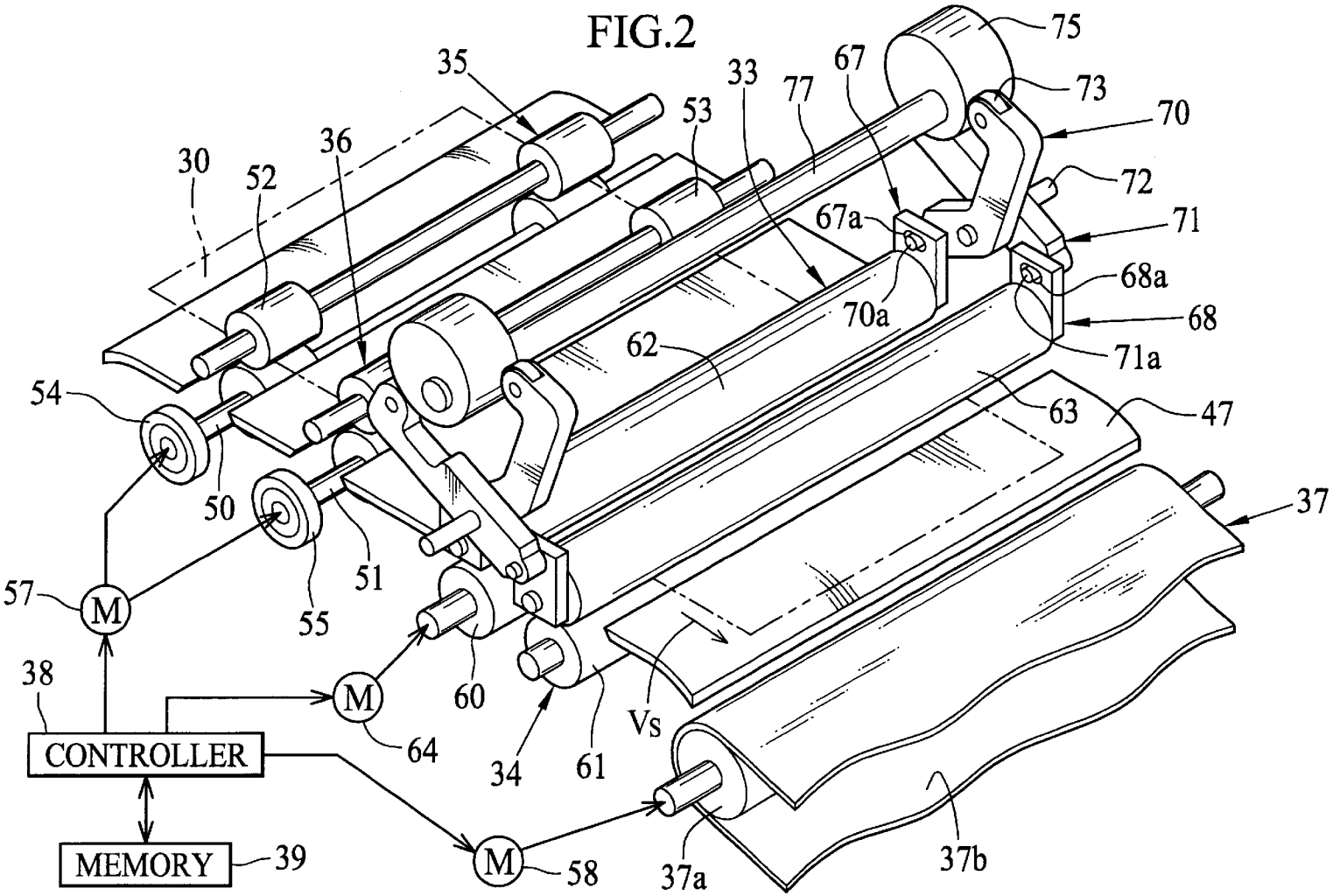
FIG. 2 is a perspective view of the sheet feeding device.
Figure 3:
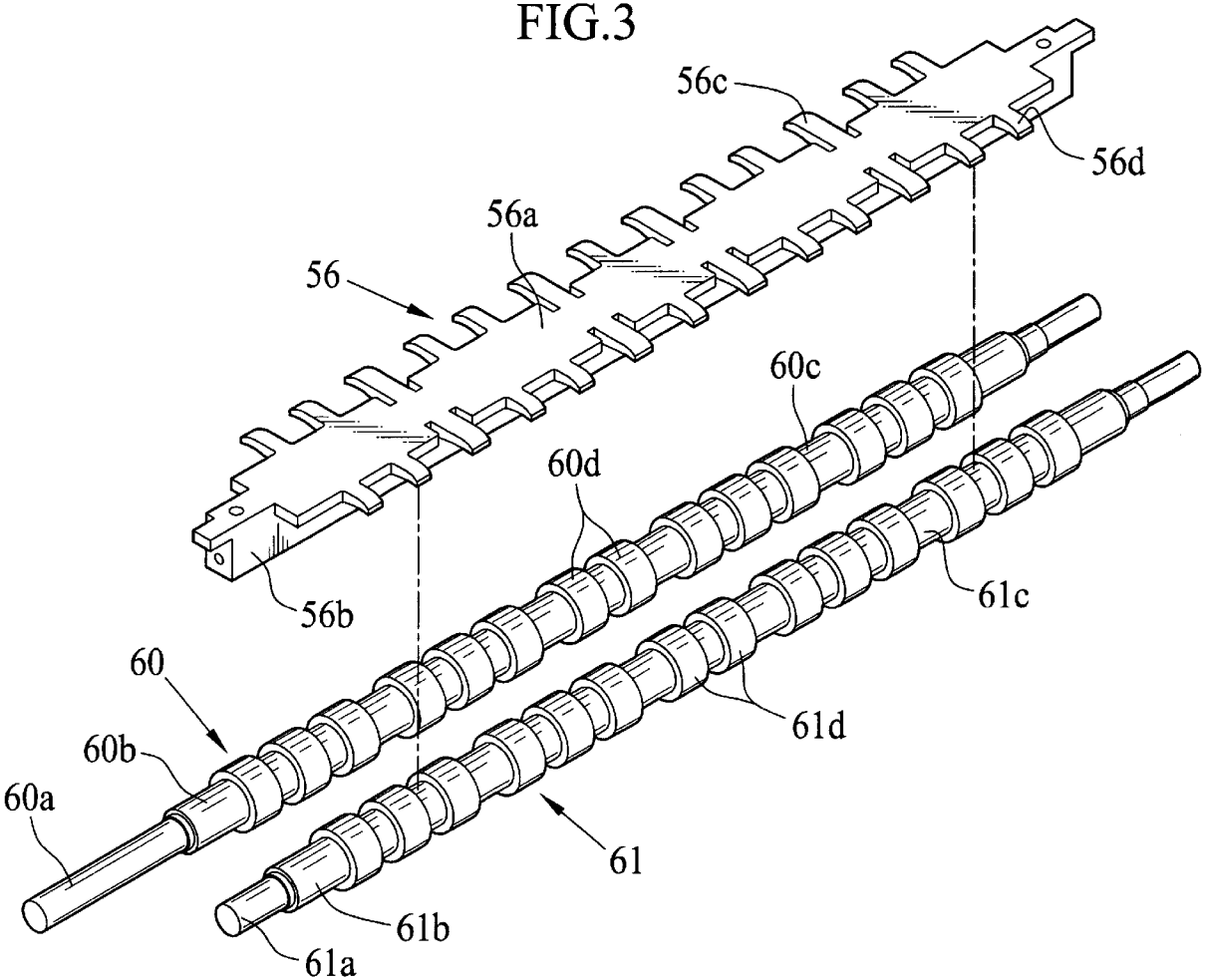
FIG. 3 is a perspective view of a capstan roller and a sheet guide.

In FIG. 2, a sheet feeding device of the present invention is depicted. The sheet feeding device includes the first and second feeding roller pairs 33, 34, the transfer roller pairs 35,. 36, the belt conveyor 37, a controller 38. Practically, the first and second feeding roller pairs 33, 34 includes capstan and pinch rollers 60 to 63, each of which is divided by a plurality of orbital grooves 60*c*, 61*c*, as depicted in FIG. 3. But these grooves are omitted in FIG. 2, for the purpose of simplification of the depiction.

The transfer roller pairs 35, 36 comprise capstan rollers 50, 51 below a guide plate 47, and pinch rollers 52, 53 above the guide plate 47. The capstan rollers 50, 51 are connected to a transfer motor 57 via secondary gears 54, 55 attached to one end portions thereof. The controller 38 drives the transfer motor 57 through a motor driver (not shown) based on feeding speed data stored in a memory 39, to rotate the capstan rollers 50, 51. The controller 38 rotates the transfer roller pairs 35, 36 such that the maximum feeding speed of the transfer roller pairs 35, 36 including deviation is smaller than the feeding speed Vs of the feeding roller pairs 33, 34. One-way clutches are attached to the inside of secondary gears 54, 55. When nipped by the first feeding roller pair 33, the one-way clutches are actuated to make the capstan rollers 50, 51 free. Then, the capstan rollers 50, 51 rotate at the same speed as the first feeding roller pair 33.

The first feeding roller pair 33 is consisted of a capstan roller 60 and a pinch roller 62, which are located below and above the guide plate 47 respectively. The second feeding roller pair 34 is also consisted of a capstan roller 61 and a pinch roller 63, which are located below and above the guide plate 47 respectively. The capstan roller 60 of the first feeding roller pair 33 is connected to a feeding motor 64 via transmission belt (not shown). As for the feeding motor 64, a pulse motor with five-phase, one-hundred-teeth type can be used. The feeding motor 64 is controlled by a controller 38 through a motor driver (not shown). The controller 38 sends drive pulses to the feeding motor 64 so as to rotate the feeding motor at a certain speed, for instance, more than ten revolutions per second. Pulse rate data for driving the feeding motor 64 is stored in the memory 39, and is read out by the controller 38.

Figure 5:
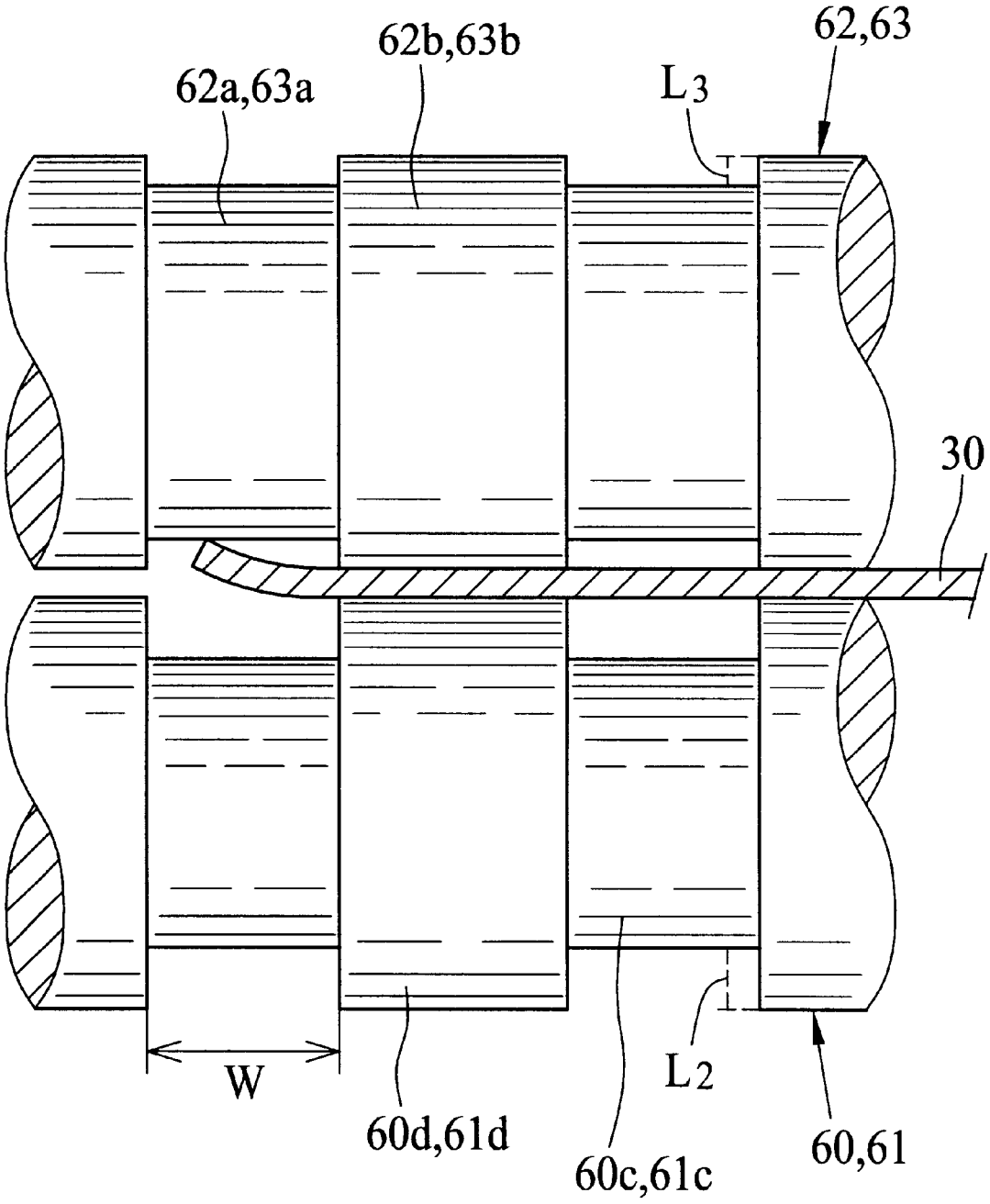
FIG. 5 is a front elevation view of the capstan and pinch rollers, with parts partially broken away.

Between the pinch rollers 62, 63 is provided a tension pulley 69 (see FIG. 5). A steel belt with no elasticity is stretched between the capstan rollers 60, 61 and the tension pulley 69. When the single feeding motor 64 is driven, both two capstan rollers 60, 61 rotate at a same speed with high accuracy.

The recording sheet 30 from the transfer roller pairs 35, 36 is nipped by the capstan roller 60, 61 and the pinch roller 62, 63. When the capstan rollers 60, 61 rotates, the recording sheet 30 is fed in a direction shown by an arrow (sub scan direction) at a speed Vs. In conveyance, the exposure device 32 is activated to project linear recording light beams along a main scan direction, perpendicular to the sub-scan direction, toward an exposure position 66 (see FIG. 6). Thereby, an image is recorded onto the recording sheet 30 line by line.

Thereafter, the recording sheet 30 is fed to the belt conveyor 37 from the second feeding roller pair 34. The belt conveyor 37 comprises a conveyor roller 37*a* and a conveyor belt 37*b*. The conveyor belt 37*b* is bound around the conveyor roller 37*a*, on which the recording sheet 30 is transported. The controller 38 drives a conveyor motor 58 to rotate the conveyor roller 37*a* such that the minimum feeding speed of the belt conveyor 37, including deviation, is larger than the feeding speed Vs of the feeding roller pairs 33, 34. Thus, while the tailing end portion of the recording sheet 30 is nipped by the second feeding roller pair 34, the recording sheet 30 is fed at the speed Vs with the leading end portion thereof being slipped on the conveyor belt 37*b*.

In FIG. 3, the capstan rollers 60, 61 has metal axial portions 60*a*, 61*a*, and silicon rubbers 60*b*, 61*b* for covering the axial portions 60*a*, 61*a*. The silicon rubbers 60*b*, 61*b* has a plurality of orbital grooves 60*c*, 61*c* along the axial direction. By the orbital grooves 60*c*, 61*c*, the outer surfaces of the capstan rollers 60, 61 are divided into plural roller bodies 60*d*, 61*d*, to reduce strain or deformation of the recording sheet in the widthwise direction (main scan direction).

Figure 4:
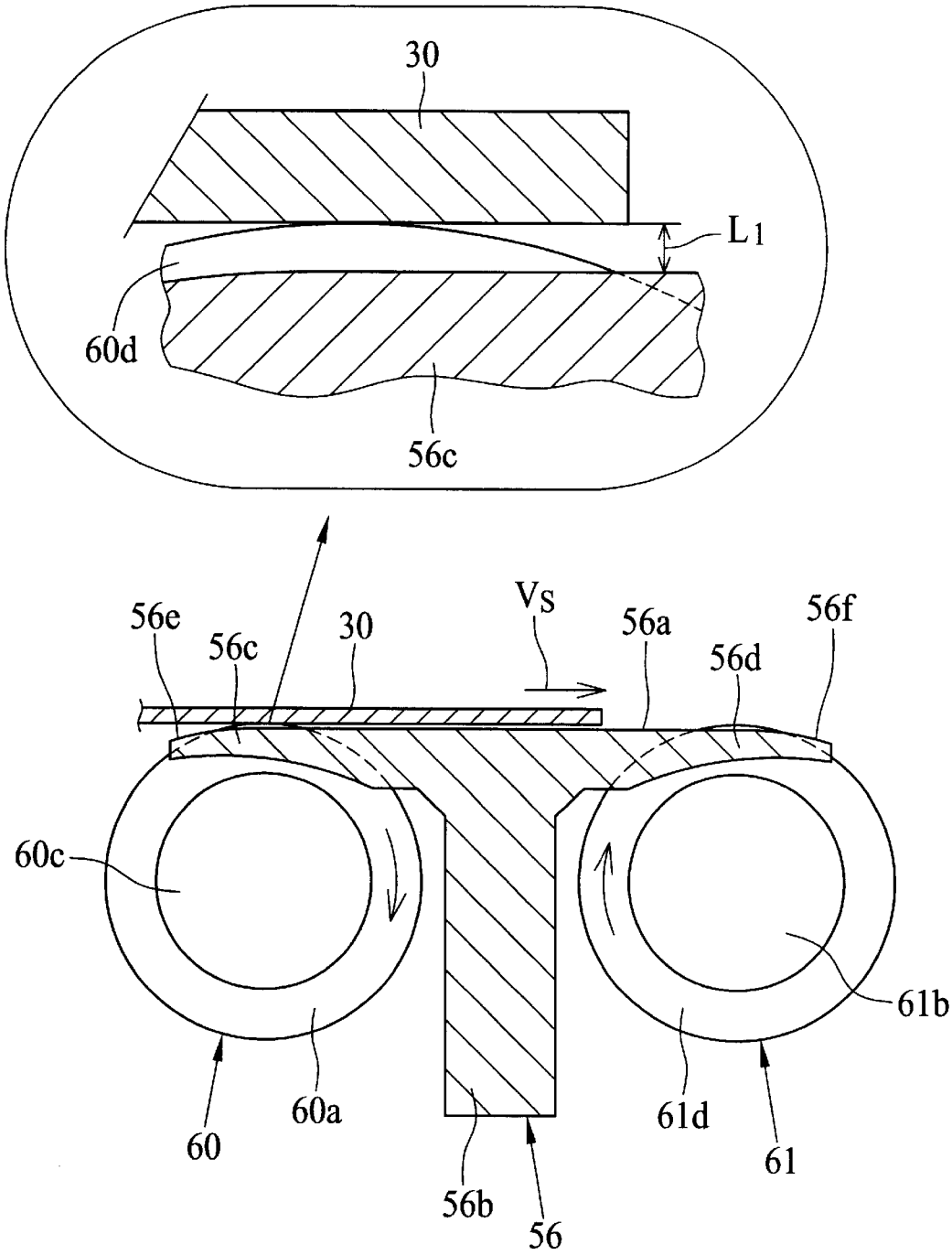
FIG. 4 is a sectional view of a capstan roller and a sheet guide with parts partially enlarged.

Between the capstan rollers 60, 61 is provided a sheet guide 56, which has an T-shaped vertical section. The sheet guide has a flat guide plate 56*a*, and an installation plate 56*b* extended below the guide plate 56*a*. As shown in FIG. 4, the sheet guide 56 is fixed at a position where the top surface of the guide plate 56*a* is slightly lower than the top of the capstan rollers 60, 61. The difference L1 between the levels of the guide plate 56*a* and the capstan rollers 60, 61 is within a range 0.01 mm to 0.08 mm, more preferably, 0.02 mm to 0.07 mm. When the recording sheet 30 is nipped, the capstan rollers 60, 61 are deformed by the pressure of the pinch roller 62, 63. Thereby, the recording sheet 30 is located approximately at the same level as the top surface of the guide plate 56*a*, and smoothly conveyed toward the second feeding roller pair 34, without being caught by the guide plate 56*a*.

A plurality of guide projections 56*c*, 56*d* are integrated with both lateral sides of the guide plate 56*a*, which has a comblike shape. These guide projections 56*c*, 56*d* are inserted into the orbital grooves 60*c*, 61*c* respectively, and are tapered off to have a pair of tapered guide surfaces 56*e*, 56*f*. These tapered guide surfaces 56*e*, 56*f* are designed to fit the bottom surfaces of the orbital grooves 60*c*, 61*c*, and enables smooth conveyance of the recording sheet 30 between the two capstan rollers 60, 61 by way of the guide plate 56*a*.

Moreover, the tapered guide surfaces 56*e*, 56*f* can decrease the impact on the recording sheet 30 at the time when the leading end of the recording sheet 30 reaches the second feeding roller pair 34, and when the trailing end of the recording sheet 30 passes the first feeding roller pair 33. Accordingly, it is possible to reduce deviation in feeding speed and exposure unevenness, which are caused by impact on the recording sheet 30. In feeding the recording sheet 30 with curls extended downwards, the guide projections 56*c*, 56*d* have remarkable impact-reduction effect on the recording sheet 30.

As shown in FIG. 5, each of the pinch rollers 62, 63 has a metal axial portion covered with silicon rubber. In the same way as the capstan rollers 60, 61 the pinch rollers 62, 63 have plural orbital grooves 62*a*, 63*a* arranged in the axial direction (main scan direction), which divide the outer surfaces of the silicon rubber into plural roller bodies 62*d*, 63*d*. Difference between the pinch rollers 62, 63 and the capstan rollers 60, 61 is depth of orbital grooves. The depth L2 of the orbital grooves 60*c*, 61*c* of the capstan rollers 60, 61 is set to 1 mm, whereas the depth L3 of the orbital grooves 62*c*, 63*c* of the pinch rollers 62, 63 is set to 0.3 mm. The bottom surfaces of the orbital grooves 62*c*, 63*c*, shallower than the opposite orbital grooves 60*c*, 61*c*, can keep the both lateral sides of the recording sheet 30 from being curled. Moreover, the roller bodies 62*b*, 63*b*, divided by the orbital grooves 62*a*, 63*a*, can decrease strain or deformation of the recording sheet 30 with respect to the main scan direction. These operations are effective in reducing exposure unevenness.

When the depth L3 of the pinch rollers 62, 63 is more than 0.7 mm, the curl-reduction effect of the orbital grooves 62*c*, 63*c* is weakened, and may cause exposure unevenness. On the other hand, the strain-reduction effect is weakened when the depth L3 is less than 0.2 mm. Thus, it is preferable to set the depth L3 of the pinch rollers 62, 63 within a range 0.2 mm to 0.7 mm. The orbital grooves 62*c*, 63*c* with depth of 0.3 mm, as shown in this embodiment, can reduce both strain and curl of the recording sheet 30 most effectively. In addition, the width W of the orbital grooves 60*c*, 61*c*, 62*c*, 63*c* is preferable to be within a range from 5 mm to 15 mm.

In FIG. 2, brackets 67, 68 retains the lateral ends of the pinch rollers 62, 63 in a rotatable manner. The brackets 67, 68 are slidable up and down by guide members (not shown). Tension springs 82, 83 (see FIG. 6) biases the brackets 67, 68 downward, to press the pinch rollers 62, 63 onto the capstan rollers 60, 61. The brackets 67, 68 have engaging holes 67*a*, 68*a*, into which guide pins 70*a*, 71*a* of drive levers 70, 71 are inserted.

The drive levers 70, 71 are intersected with each other, and are rotatable around an installation pin 72. Guide pins 70*a*, 71*a* are formed on one end portions of the drive levers 70, 71, and cam followers 73, 74 are attached to the other end portions of the drive levers 70, 71 in a rotational manner. The cam followers 73, 74 come in contact with outer surfaces of an eccentric cam 75.

The brackets 67, 68, the drive levers 70, 71, the installation pin 72, the cam followers 73, 74, and the eccentric cam 75 are provided in both end portions with respect to the main scan direction, as shown in FIG. 2.

As shown in FIGS. 6 to 9, the eccentric cam 75 is driven by a cam drive motor 76 through a motor driver (not shown). Rotation of the eccentric cam 75 is controlled by the controller 38, based on rotation speed data stored in the memory 39. When the cam drive motor 76 is activated, the eccentric cam 75 begins to rotate about the pivot 77. A pair of position sensors 80, 81 are disposed above the passage of the recording sheet 30. Each of the position sensors 80, 81 is connected to the controller 38, and has a light emitter and a photo detector. The light emitter of the rear position sensor 80 emits detection light toward a position rear of the rear pinch roller 62, and the light emitter of the front position sensor 81 emits detection light toward a position between the pinch rollers 62, 63. The photo detectors detect the reflected detection light. When an intensity of the reflected detection light is changed, the controller detects the leading or trailing edge of the recording sheet 30 is passed below the position sensors 80, 81. A photo detector and a light emitter may be separated. In that case, one of the photo detector and the light emitter is positioned below the passage, and the other one is positioned above the passage.

Figure 6:
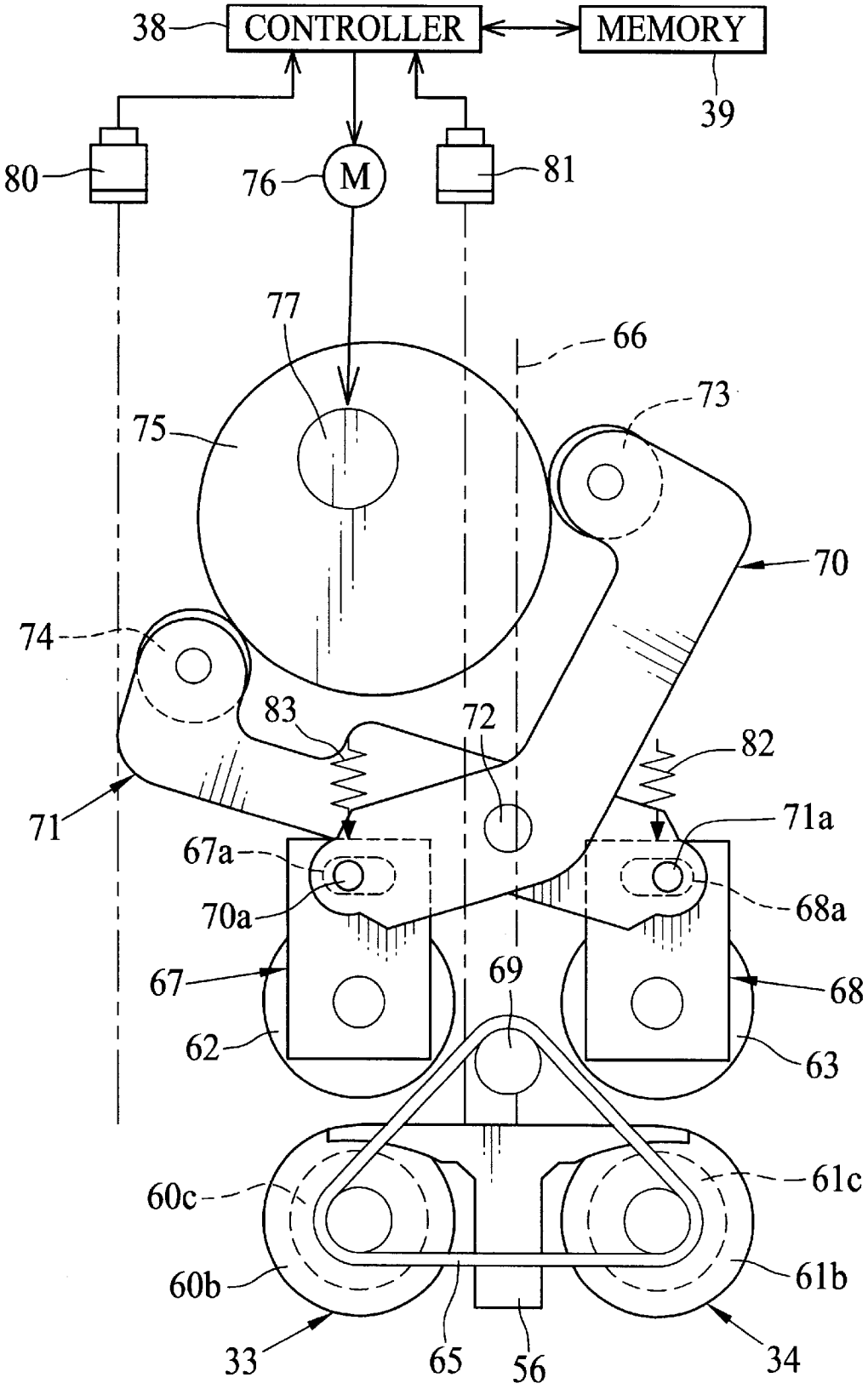
FIG. 6 is a side elevation view of the sheet feeding device in a state before feeding a recording sheet.

When the recording sheet 30 is not conveyed, the eccentric cam 75 is retained at a position to depress the other end portions of the drive levers 70, 71 against the biases of the tension springs 82, 83, as shown in FIG. 6. Since the capstan rollers 62, 63 are away from the capstan rollers 60, 61, the silicon rubbers of the rollers 60 to 63 can be prevented from deformation.

Figure 7:
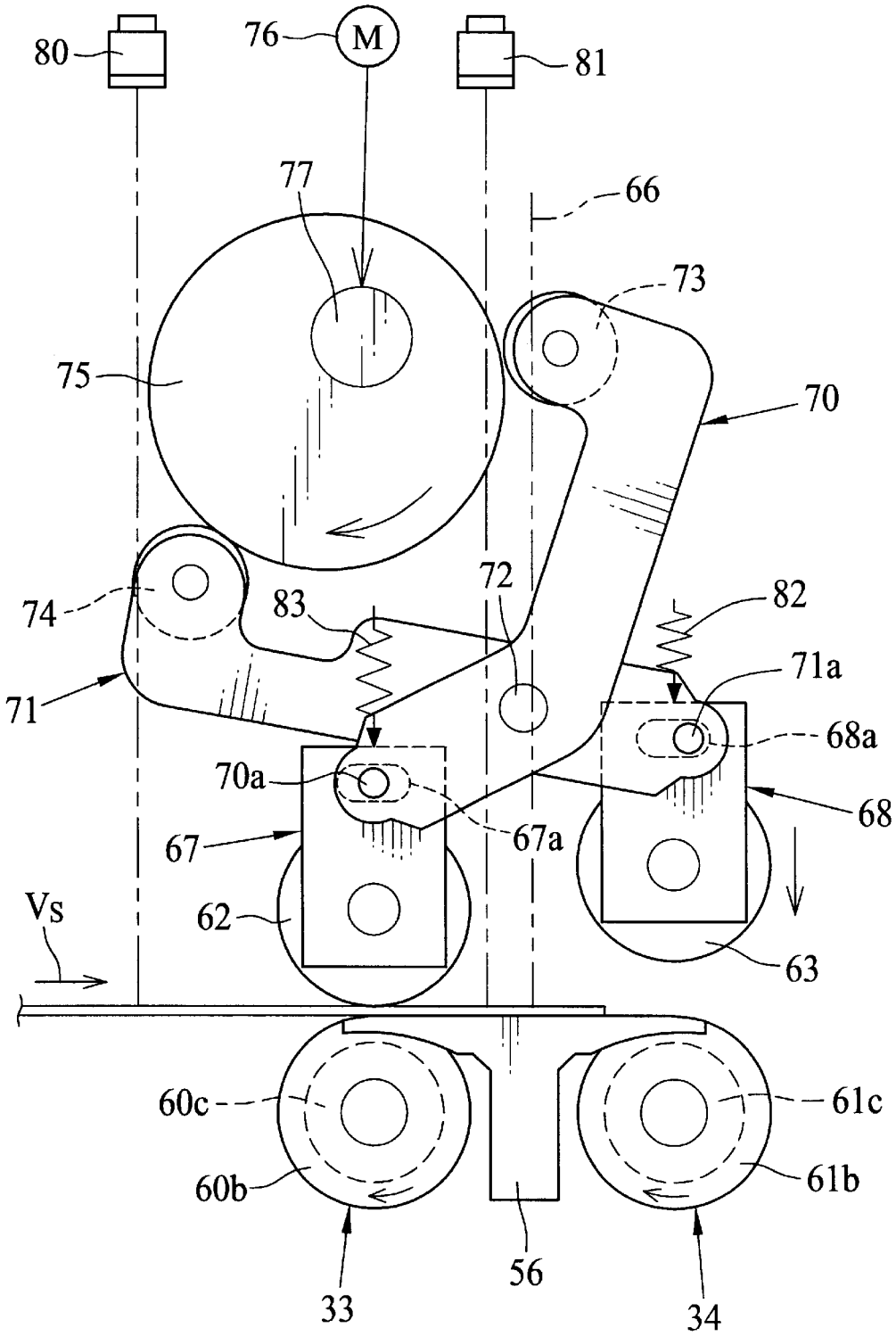
FIG. 7 is a side elevation view of the sheet feeding device in a state after an leading end of the recording sheet passes a rear position sensor.
Figure 8:
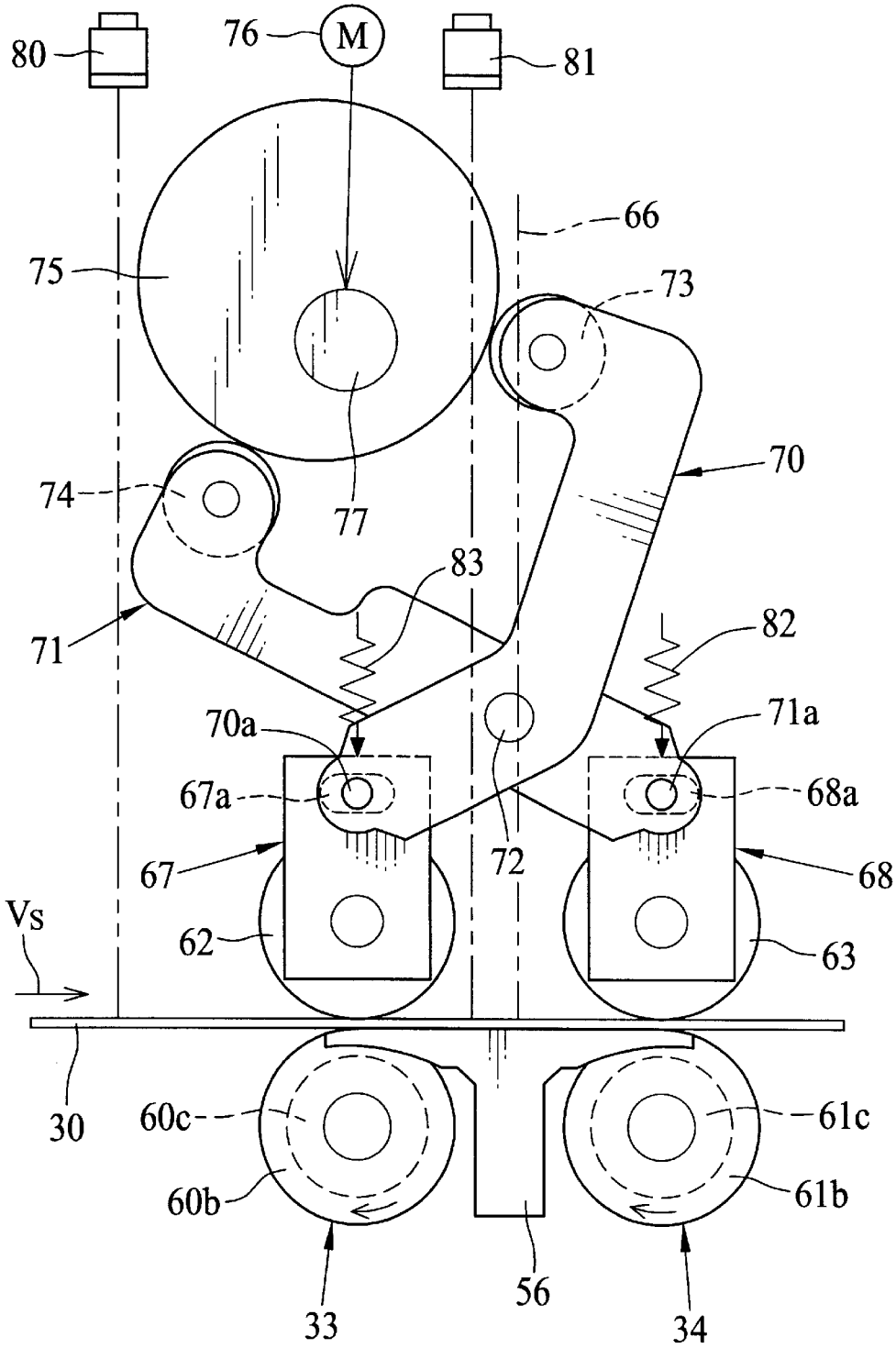
FIG. 8 is a side elevation view of the sheet feeding device in a state after the leading end of the recording sheet passes a second feeding roller pair.
Figure 9:
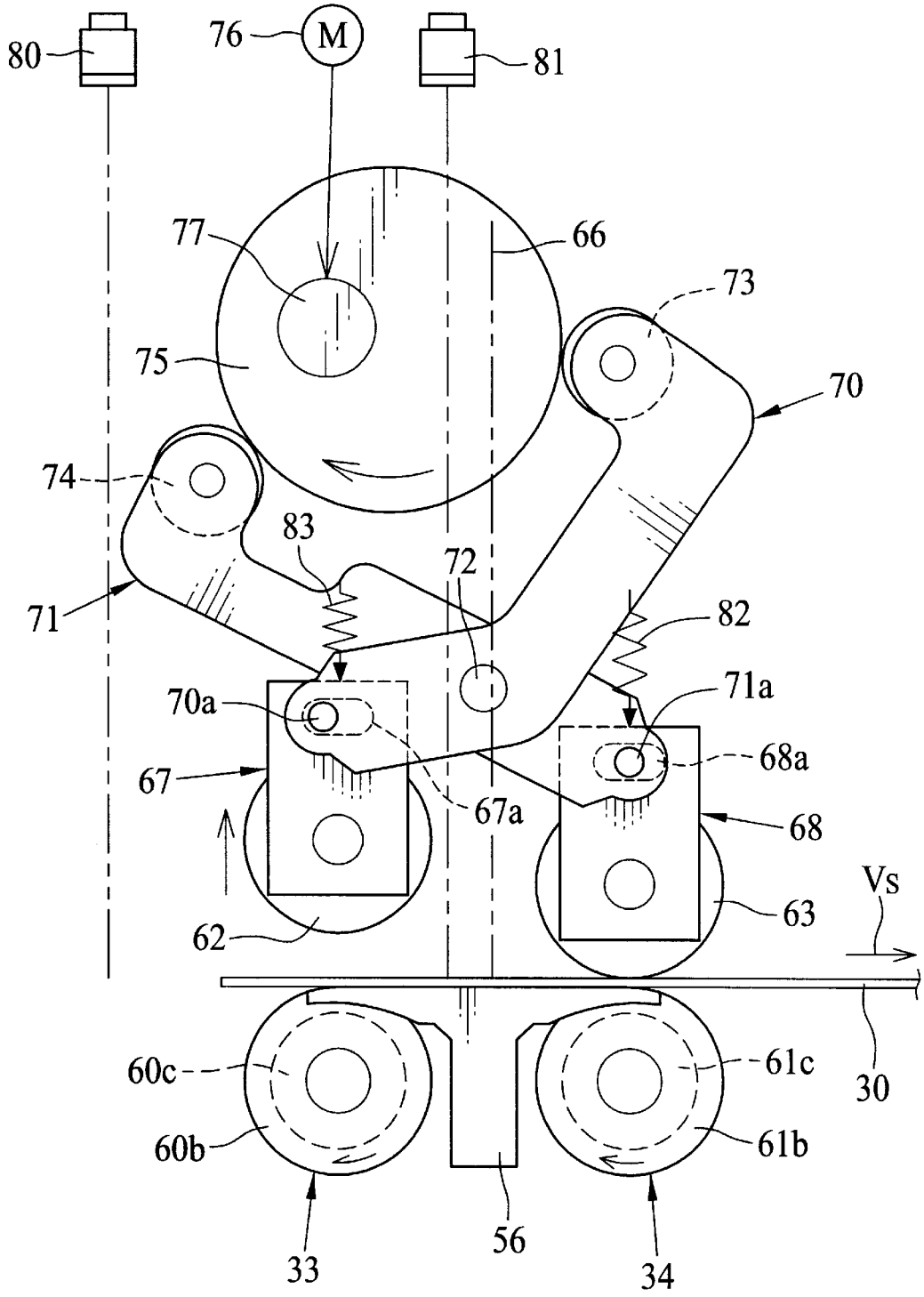
FIG. 9 is a side elevation view of the sheet feeding device in a state after the leading end passes a front position sensor.

When the recording sheet 30 is fed from the transfer roller pairs 35, 36, the controller 38 drives the cam drive motor 76 to rotate the eccentric cam 75 in the clockwise direction to a position shown in FIG. 7. The upstream drive lever 70 rotates in the counterclockwise direction, to move the upstream pinch roller 62 to the nip position. After nipping the recording sheet 30, the first feeding roller pair 33 feeds the recording sheet 30 in the sub-scan direction. When the leading end of the recording sheet 30 passes the downstream position sensor 81, the controller 38 drives the cam drive motor 76 to rotate the eccentric cam 75 in the counterclockwise direction to a position shown in FIG. 8. Then, the downstream drive lever 71 rotates in the clockwise direction to move the downstream pinch roller 63 toward the nip position, whereas the upstream pinch roller 62 is kept at the nip position. The controller 38 rotates the eccentric cam 75 such that the downstream pinch roller 63 reaches the nip position after the leading end of the recording sheet 30 passes the second feeding roller pair 34. Since the recording sheet 30 is not thrust into the second feeding roller pair 34, it is possible to reduce the impact on the recording sheet 30 in passing through the second feeding roller pair 34.

During conveyance by use of the rollers 60 to 63, the orbital grooves 60*c*, 61*c*, 62*c* and 63*c* of the rollers 60 to 63 relax the strain of the recording sheet 30 with respect to the widthwise direction (main scan direction). Also the orbital grooves 62*c*, 63*c* of the pinch rollers 62, 63, shallower than the orbital grooves 60*c*, 61*c* of the capstan rollers 60, 61, can hold the lateral sides of the recording sheet 30, to press the curl of the recording sheet down. Thereby, the recording light beams from the exposure device 32 can be applied to the correct position on the recording sheet 30.

The recording sheet 30 is fed by the first and second feeding roller pairs 33, 34 in a direction shown by an arrow (sub-scan direction) at the speed Vs. When the trailing end of the recording sheet 30 passes the upstream position sensor 80, the controller 38 drives the cam drive motor 76 to rotate the eccentric cam 75 in the counterclockwise direction to a position shown in FIG. 9. The upstream drive lever 70 rotates in the clockwise direction to move the upstream pinch roller 62 upward toward the retract position, whereas the downstream pinch roller 63 is retained at the nip position. The controller 38 rotates the eccentric cam 75 such that the upstream pinch roller 62 is away from the recording sheet 30 before the trailing edge of the recording sheet 30 passes the first feeding roller pair 33.

After the exposure, the trailing end of the recording sheet 30 passes the second feeding roller pair 34. Then, the controller 38 drives the cam drive motor 76 to rotate the eccentric cam 75 to the position shown in FIG. 7. When the succeeding recording sheet 30 is fed from the transfer roller pairs 35, 36, the eccentric cam 75 rotates to move the pinch rollers 62, 63, in the same way as above.

In the above embodiment, the orbital grooves 62*c*, 63*c* of both pinch rollers 62, 63 are designed to be shallower than that of the capstan rollers 60, 61. But only the pinch roller 63 of the second feeding roller pair 34 may have shallow orbital grooves.

In the above embodiment, silicon rubbers are used for covering the capstan and pinch rollers 60 to 63, but other materials with elasticity are applicable to the present invention.

In the above embodiment, the orbital grooves 62*c*, 63*c* of both pinch rollers 62, 63 suppresses the curl of the recording sheet 30, but it is possible to determine positions of roller bodies 62*d*, 63*d* according to the sheet widths. Several kinds of recording sheets with different widths are used in the printer processor 10, but the kinds of the recording sheet is not infinite. Thus, by determining the positions of the roller bodies 62*d*, 63*d* such that both lateral ends of the plural kinds of recording sheets come in contact with the roller bodies 62*d*, 63*d* of the pinch roller 62, 63. In that case, both lateral ends of recording sheets of different widths are pressed by the roller bodies 62*d*, 63*d*. So it is also possible to prevent the curl of the recording sheets, and thus possible to perform proper exposure to the recording sheets.

The present invention is applicable to provide print devices other than the laser printer. For instance, an ink jet printer may be provided instead of the exposure device 32. In that case, because of no deviation in feeding speed of a recording sheet, recording ink dots from a ink-jet head are applied onto the recording sheet with high accuracy. The present invention is also applicable to a feeding device, of an image scanner.

Thus, the present invention is not to be limited to the above embodiments, but on the contrary, various modifications are possible to those skilled in the art without departing from the scope of claims appended hereto.

What is claimed is:

1. A device for feeding a sheet-type recording material along a passage which has a record position for recording an image, said device comprising:

a first feeding roller pair which nips and feeds said recording material toward a record position, said first feeding roller pair including a first pinch roller and a first capstan roller, said first pinch roller being located in a recording surface side of said recording material, and said first capstan roller being located in an opposite side to said first pinch roller with respect to said passage;

a second feeding roller pair which nips and feeds said recording material after passing said record position, said second feeding roller pair including a second pinch roller and a second capstan roller, said second pinch roller being located in the same side as said first pinch roller, and said second capstan roller being located in the same side as said first capstan roller; and a plurality of orbital grooves formed in an outer surface of said second pinch roller and arranged in an axial direction of said second pinch roller, the depth of said orbital grooves of said second pinch roller being within a range of 0.2 mm to 0.7 mm.

2. A device as defined in claim 1, further comprising a plurality of orbital grooves formed in an outer surface of said first pinch roller and arranged in an axial direction of said first pinch roller, the depth of said orbital grooves of said first pinch roller being within a range of 0.2 mm to 0.7 mm.

3. A device as defined in claim 2, further comprising a plurality of orbital grooves formed in outer surfaces of said first and second capstan roller and arranged in axial directions of said first and second capstan rollers, said orbital grooves of said first and second capstan rollers confronting said orbital grooves of said first and second pinch rollers.

4. A device as defined in claim 3, wherein said orbital grooves of said first and second capstan rollers having a depth of 1.0 mm.

5. A device as defined in claim 3, wherein said first and second capstan rollers, and said first and second pinch rollers are covered with elastic material.

6. A device as defined in claim 5, further comprising a guide member disposed between said first and second capstan rollers, said guide member having a guiding surface for supporting said recording material;

wherein the top level of said first and second capstan rollers is 0.01 mm to 0.08 mm higher than the level of said guiding surface.

7. A device as defined in claim 6, wherein said guide member includes a plurality of guiding projections that are extended in a feeding direction of said recording material, each of said guiding projections being fit into each of said orbital grooves of said first and second capstan rollers.

8. A device as defined in claim 7, wherein said guide projections are tapered off.

9. A device as defined in claim 3, further comprising a steel belt stretched between said first and second capstan rollers, which are rotated at a same speed.

10. A device as defined in claim 3, further comprising a moving mechanism for moving said first and second pinch rollers between nip positions to press said recording material together with said capstan rollers, and retract positions to retract from said recording material.

11. A device as defined in claim 10, wherein said moving mechanism moves said first pinch roller toward said retract position before the trailing end of said recording material passes said first feeding roller pair.

12. A device as defined in claim 10, wherein said moving mechanism moves said second pinch roller to said nip position after the leading end of said recording material passes said second feeding roller pair.

13. A device as defined in claim 10, wherein said moving mechanism retains said first and second pinch rollers at said retract positions when said recording material is not fed in said passage.

* * * * *